United States Patent [19]

Schoonover et al.

[11] Patent Number: 4,923,098

[45] **Date of Patent: * May 8, 1990**

[54] FLUID CONTAINER

[76] Inventors: Michael I. Schoonover, 1218 W. Atherton; James A. McFadden, 5368 Torrey Rd., both of Flint, Mich. 48507

[ * ] Notice: The portion of the term of this patent subsequent to Nov. 1, 2005 has been disclaimed.

[21] Appl. No.: 220,424

[22] Filed: Jul. 13, 1988

Related U.S. Application Data

[63] Continuation-in-part of Ser. No. 32,323, Mar. 30, 1987, Pat. No. 4,781,314.

[51] Int. Cl.[5] ..... A47G 19/14

[52] U.S. Cl. ..... 222/456.1; 222/482; 220/72; 215/1 C

[58] Field of Search ..... 215/1 C, 10, 307; 220/72, 74, 85 SP, 288, 303; 222/478, 481–482, 465.1, 466, 528–529, 532, 537, 539, 545, 551

[56] References Cited

U.S. PATENT DOCUMENTS

| | | | |
|---|---|---|---|
| 3,329,316 | 7/1967 | Lowe | 222/183 |
| 3,386,632 | 6/1968 | Sager | 222/482 |
| 3,746,200 | 7/1973 | Flider | 222/466 |
| 4,125,207 | 11/1978 | Ernst et al. | 222/130 |
| 4,781,314 | 11/1988 | Schoonover et al. | 222/465.1 |

FOREIGN PATENT DOCUMENTS

| | | | |
|---|---|---|---|
| 254468 | 5/1963 | Australia | 222/465.1 |
| 1465560 | 1/1967 | France | 222/466 |

*Primary Examiner*—Michael S. Huppert
*Attorney, Agent, or Firm*—Gifford, Groh, Spinkle, Patmore and Anderson

[57] ABSTRACT

A fluid container has a housing arranged in a box-like fashion with two square side walls, each having four edges and four corners, two top walls adjoining one another at a corner and extending between adjacent corresponding edges of the sidewalls, and two bottom walls adjoining one another at an opposite corner and extending bewteen the two remaining adjacent corresponding sides of the side walls. Each of the top walls include a threaded neck opening to which are attached sealing cap members. A carrying handle is attached to one top wall and the remaining top and bottom walls have finger notches to facilitate grasping of the container. The container rests on the first bottom wall to be filled from the opening in the opposing top wall and emptied from the opening in the top wall when resting on the second bottom wall the opening in the adjacent top wall acts as a separate vent to facilitate pouring.

10 Claims, 2 Drawing Sheets

Fig-1
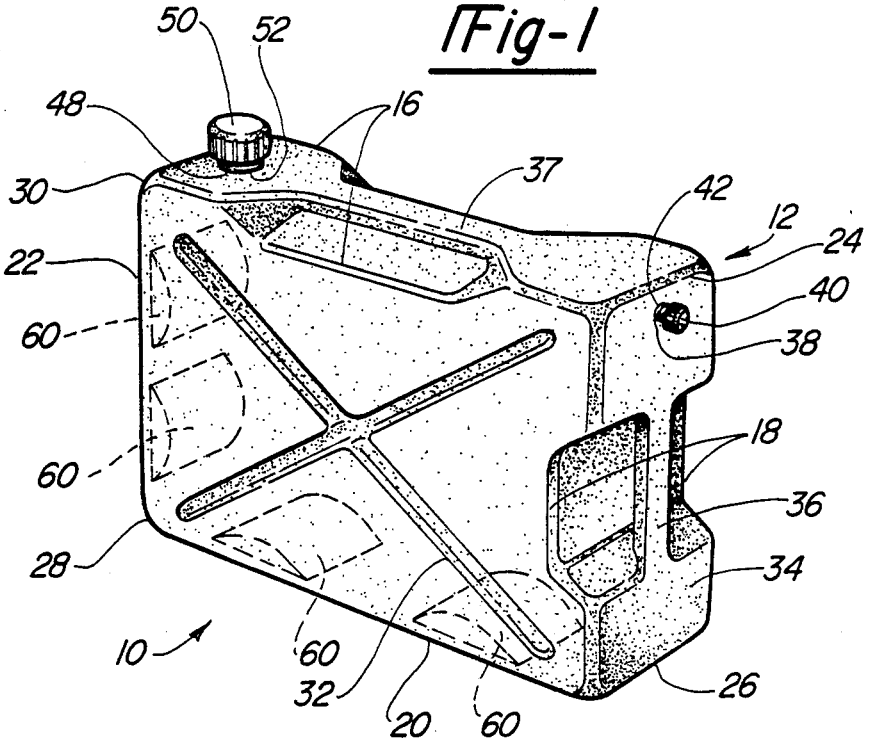
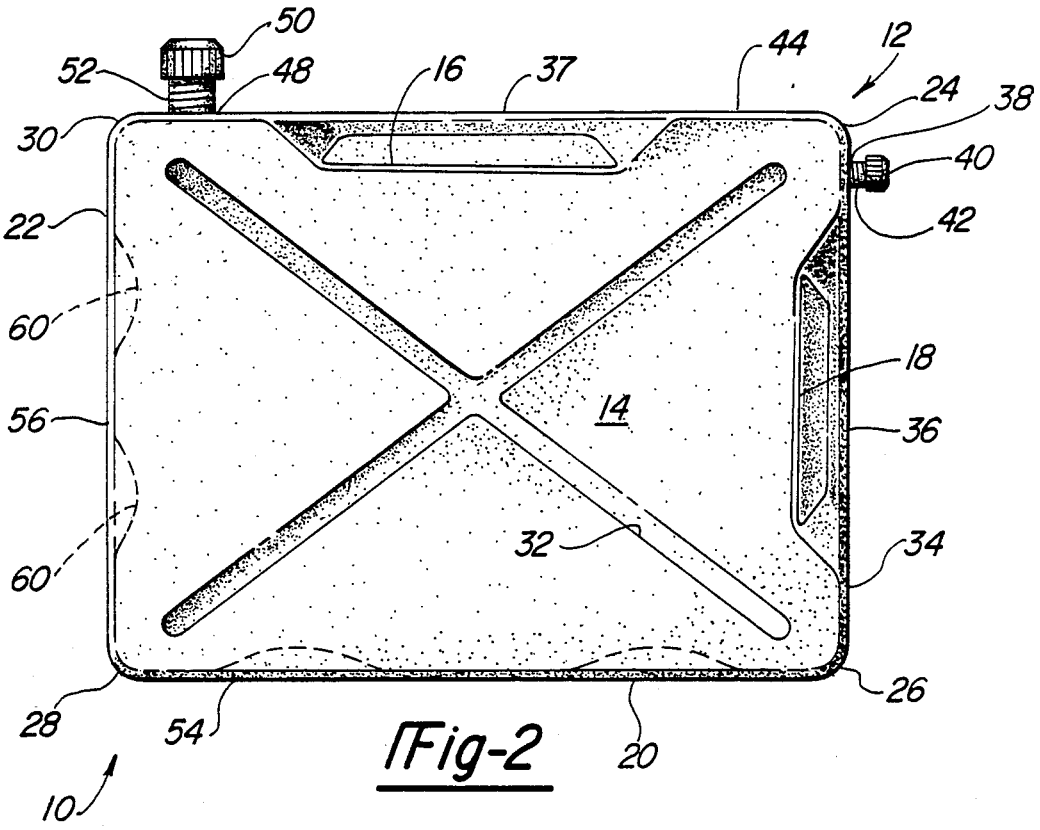
Fig-2

FLUID CONTAINER

CROSS REFERENCE TO RELATED APPLICATION

This application is a continuation-in-part of applicant's co-pending patent application Ser. No. 032,323, filed Mar. 30, 1987 now issued as U.S. Pat. No. 4,781,314.

BACKGROUND OF THE INVENTION

I. Field of the Invention

This invention relates to fluid containers and, in particular, to containers for transporting and pouring fluids such as fuel and the like.

II. Description of the Prior Art

Several types of fluid containers have previously been known in the prior art. For example, containers of metal or plastic having cylindrical or box-like shapes are commonplace in many households. Typically, these containers have a handle for carrying, a single opening for both filling the container with fluid and emptying the container of fluid, and some include a separate vent opening to admit air into the container to facilitate pouring.

An example of a typical container is disclosed in U.S. Pat. No. 3,746,200 to Flider. This patent discloses a plastic Jerry Can having a single filler/pourer opening and a handle to facilitate carrying. A vent tube originates in an upper portion of the container, extends through the handle and exits near the filler/pourer opening, to be sealed with the same cap which seals the opening. The container is adapted to be easily stacked in its upright position. However, only a single opening is provided for both filling and emptying the container.

A modified container is disclosed in U.S. Pat. No. 3,329,316 to Lowe. This patent describes a disposable cardboard container for temporarily transporting gasoline. It includes a handle for carrying, an opening in its top for filling the container, and a plastic lined tubular spout originating from a point on a side wall near the bottom of the container. During filling, the spout is collapsed and sealed to the side wall of the container and, during pouring, the spout is disengaged and lowered into position. However, the container is not reusable because the spout is not resealable. Moreover, the disposable cardboard container is not adapted for storage of fluids and cannot be stacked or otherwise positioned except in its upright orientation.

These previously known devices are fine for their intended purpose but they lack the versatility of the present invention.

SUMMARY OF THE PRESENT INVENTION

The drawbacks of the previously known fluid containers are overcome by the invention declared and claimed by the parent application, which provides a fluid container having two openings. The container includes a pair of sidewalls, each having four edges and four corners, the edges and corners of one sidewall corresponding to the edges and corners of the other sidewall in opposing fashion. A first top extends between the first corresponding edges of the two sides and includes a first opening and a handle. A second top extends between the second corresponding edges, which are adjacent the first corresponding edges, so that the second top adjoins the first top at a first corner. The second top contains a second opening and a handle, and both openings are selectively sealable with caps or other closing means.

A first bottom extends between the third corresponding edges of the two sides, opposite the first top and adjacent the second top so that the second top and the first bottom adjoin one another at a second corner. Finally, a second bottom extends between the fourth corresponding edges of the two sidewalls and adjoins the second bottom and the first top, respectively, at third and fourth corners.

In the present embodiment, the jerry can comprises a substantially box-like housing which can stand on either end of its two bottoms and can be filled from whichever opening is opposite the bottom on which it stands. Additionally, a handle is always available to the user when the jerry can is laid on either bottom thereby placing the can in an uprightable position at all times.

The side walls preferably include diagonal ridges which improve structural rigidity of the sides, and both bottoms may include finger notches which facilitate grasping the container for transporting or pouring.

BRIEF DESCRIPTION OF THE DRAWINGS

The present invention will be more fully understood by reference to the following detailed description, when read in conjunction with the accompanying drawing in which like reference characters refer to like parts throughout the several views and in which:

FIG. 1 is a perspective view of the fluid container of the present invention, shown resting on its first bottom;

FIG. 2 is a right side plan view of the container, shown resting on its first bottom;

DETAILED DESCRIPTION OF THE PREFERRED EMBODIMENT

Figure 3:
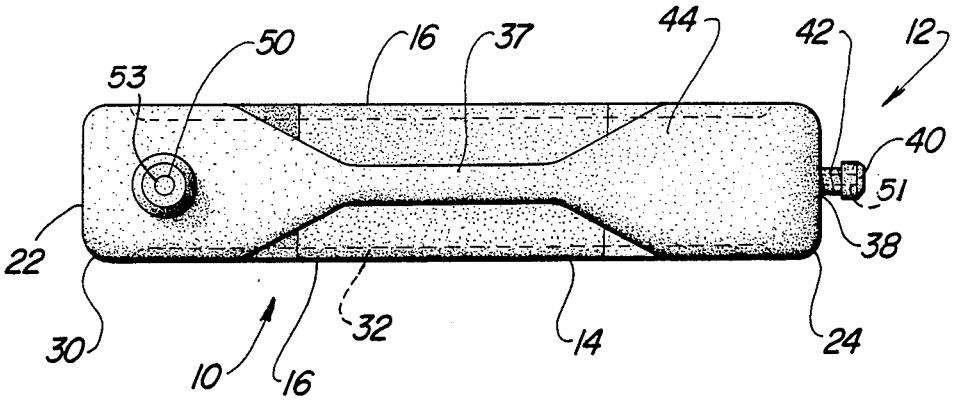
FIG. 3 is a top view of the container.
Figure 4:
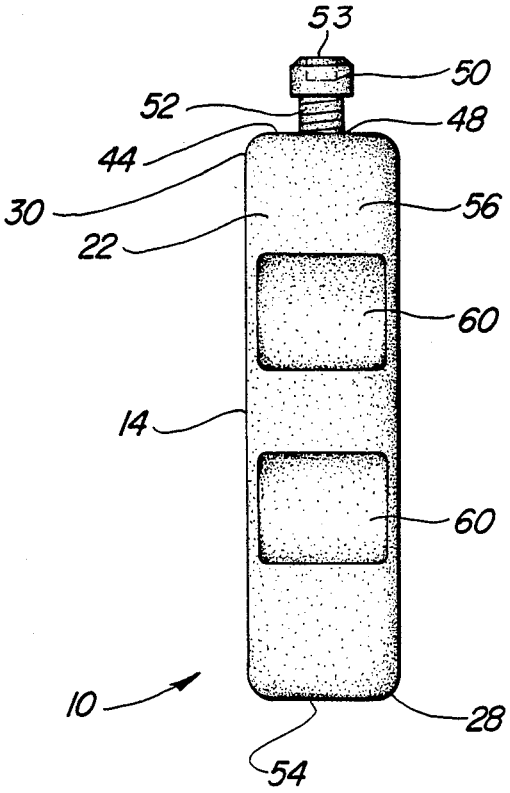
FIG. 4 is a left side view of the container.

Referring to the figures, the fluid container 10 of the present invention is thereshown comprising a housing 12 preferably made of molded plastic, although other materials, such as metal for example, are also encompassed by the invention. The housing 12 is arranged in a box-like configuration having a pair of opposed, substantially planar side walls 14 (only one shown), each of which has a set of four corresponding edges 16, 18, 20 and 22, four corners 24, 26, 28 and 30, respectively. In the first preferred embodiment shown in FIG. 1, the side walls 14 are square and the corners 24, 26, 28 and 30 are orthogonal. Preferably, the side wall 14 is reinforced by ridges 32 which extend diagonally across opposing corners, i.e. from first corner 24 to third corner 28 and from second corner 26 to fourth corner 30. The ridges 32 may be raised or depressed from the surface of the side walls 14.

A first top wall 34 extends between first corresponding edges 18 of the sides 14. The top wall 34 of the preferred embodiment includes a handle 36 and a first opening 38 which is sealable by means of a first cap or closing means 40. Ideally, the first opening 38 comprises a threaded neck portion 42 onto which the cap 40 can be sealingly engaged.

A second top wall 44 extends between second corresponding edges 16 which are adjacent first corresponding edges 18. The second top 44 therefore is adjacent the first top 34 and is adjoined thereto at the first corner 24. The second top wall 44 in the preferred embodiment includes a handle 37 and a second opening 48, including a second threaded neck portion 52, which can be closed by a second closing means or cap 50.

For a reason which will be subsequently described, the opening 38 is located adjacent the corner 24.

A first bottom wall 54 extends between the third corresponding edges 20 so that the first bottom 54 adjoins the first top 34 at second corner 26. In a similar fashion, a second bottom 56 extends between the fourth corresponding edges 22 and adjoins the first bottom 54 at the third corner 28, as well as the second top 44 at the fourth corner 30.

Preferably, each of the top and bottom walls 34, 44, 54 and 56 form 90 degree angles, between themselves and the side walls 14, as well as between themselves at the respective corners. This creates the cube or box-like housing 12. However, other angles and rounded edges or corners are also within the scope of this invention.

As shown in the drawing, each of the two bottom walls 54, 56 include indentations or notches 60 into which fingers may be inserted to facilitate grasping the container 10. Preferably, the notches 60 are triangular and extend all the way from one side wall 14 to the other. The bottoms 54 and 56 each may have a plurality of notches 60 as space allows. The notches 60, in conjunction with the handles 36, 37 facilitate maneuvering the container 10 for storing and/or pouring fluid from the container.

As shown in FIG. 3, the caps 40, 50 preferably include vents 51 or release valves 53 which serve to relieve pressure build-up inside the housing 12, and also serve to admit air into the container to eliminate the build-up of a vacuum while pouring fluid out of the container.

The container 10 can be made in any size or volume. By way of illustration only and therefore not limiting, volumes of approximately 2 and 5 quarts, as well as 1, 3, 5 and 6 gallons are contemplated. These are deemed to be convenient particularly for transporting oils and fuels for automotive applications. Nevertheless other sizes and applictions are within the ambit of this invention.

Having described the structural features of the present invention, its advantageous operation can be easily understood. The housing 12 is constructed in a substantially box-like configuration to minimize the storage space required by the container 10. Moreover, by employing two bottom ways 54, 56, the container 10 of the present invention can be stored in two orientations with a corresponding handle 36, 37 available to the user, (one being shown in FIG. 1). In the orientation shown in FIG. 1, top wall 44 remains upright, and its corresponding opening 48 is situated at an uppermost location of the housing 12. Conversely, the other of the openings 38 is also situated at an uppermost point of the housing 12, which is important for complete emptying of the container 10.

To use the container 10, the operator simply removes the cap 50 from the opening 48 in the upright position shown in FIG. 1 and dispenses fluid into the container 10. The container is then lifted by means of the handles 36, 37 and is transported to a desired location. Upon arrival, the cap 50 of the opening 40, upright at this time, is removed. The container 10 is then tilted on to its second bottom so that the opening 48 becomes the lowermost of the openings 38, 48. Fluid can then flow from the interior of the housing 12 through the opening 48, facilitated by the admittance of air through the upmost opening 38, which acts as a vent when the cap 40 is removed.

The foregoing detailed description of the preferred embodiment has been given for clearness of understanding only and no unnecessary limitations should be understood therefrom. Some modifications will be obvious to those skilled in the art to which the invention pertains, without deviation from the spirit of the invention as defined by the scope of the appended claims:

We claim:

1. A container for fluids comprising, in combination:

two opposed sides, each of said sides having four edges, the edges of one of said sides corresponding to the edges of the other of said sides;

a first top extending between a first pair of corresponding edges of said two sides including a first neck defining an opening;

a second top extending between a second pair of corresponding edges of said two sides including a second neck defining a second opening; said second pair of corresponding edges extending from ends of said first pair of corresponding edges so that said second top adjoins said first top at a first corner;

a first bottom extending between a third pair of corresponding edges of said two sides, said third pair of corresponding edges being adjacent said second pair of corresponding edges so that said first bottom adjoins said second top at a second corner;

a second bottom extending between a fourth pair of corresponding edges of the two sides, said fourth pair of corresponding edges extending from said third pair of corresponding edges and to said first pair of corresponding edges so that said second bottom adjoins said first bottom and said first top, respectively, at third and fourth corners; said two sides, two tops and two bottoms together defining a housing, each of said first and second bottoms being adapted to allow stable resting of said housing on either one of said bottoms; and a pair of caps each securable to said first and second necks; and a first handle extending between said first pair of corresponding edges of said two sides of said first top; and a second handle extending between said pair of corresponding edges of said two sides of said second top.

2. The container as defined in claim 1 wherein said first and second necks are located on said first and second tops adjacent said fourth and first corners, respectively, near said second bottom and said second top thereby allowing substantially complete drainage of said container when said container rests on said second bottom with said first neck open for ventilation.

3. The container as defined in claim 1 wherein said sides are rectangular so that said corners comprise substantially right angles, and said housing defines a box-like interior.

4. The container as defined in claim 3 wherein said sides are square.

5. The container as defined in claim 3 wherein said sides include reinforcing ridges extending diagonally from corner to corner across said sides.

6. The container as defined in claim 1 wherein at least one of said first and second bottoms includes finger notches to facilitate grasping said container.

7. The container as defined in claim 1 wherein at least one of said caps includes a vent to relieve pressure in the interior of said housing.

8. The container as defined in claim 1 wherein said housing is composed of molded plastic.

9. The container as defined in claim 1 wherein said housing is composed of metal.

10. The container as defined in claim 1 wherein said first and second necks each include external threading and said spout and pairs of caps matching internal threading.

* * * * *